US005526433A

United States Patent [19]

Zakarauskas et al.

[11] Patent Number: 5,526,433

[45] Date of Patent: Jun. 11, 1996

[54] TRACKING PLATFORM SYSTEM

[75] Inventors: Pierre Zakarauskas, Victoria; Max S. Cynader, West Vancouver, both of Canada

[73] Assignee: The University of British Columbia, Vancouver, Canada

[21] Appl. No.: 440,425

[22] Filed: May 12, 1995

Related U.S. Application Data

[63] Continuation of Ser. No. 54,968, May 3, 1993, abandoned.

[51] Int. Cl.[6] ..... H04R 3/00

[52] U.S. Cl. ..... 381/92; 367/104; 367/120

[58] Field of Search ..... 381/110, 92, 122; 367/104, 120

[56] References Cited

U.S. PATENT DOCUMENTS

| | | | |
|---|---|---|---|
| 2,856,772 | 10/1958 | Strihafka . | |
| 3,109,066 | 10/1963 | David . | |
| 3,588,797 | 6/1971 | Triebold . | |
| 3,614,723 | 10/1971 | Hermes | 367/120 |
| 4,037,052 | 7/1977 | Doi . | |
| 4,577,299 | 3/1986 | Blaschke et al. | 367/120 |
| 4,586,195 | 4/1986 | DeGeorge | 381/92 |
| 4,696,043 | 9/1987 | Iwahara . | |
| 4,802,227 | 1/1989 | Elko . | |
| 5,231,483 | 7/1993 | Sieber et al. | 358/125 |

FOREIGN PATENT DOCUMENTS

| | | | |
|---|---|---|---|
| 1241436 | 8/1988 | Canada . | |
| 56-4073 | 1/1981 | Japan | 367/120 |
| WO85020 | 5/1985 | WIPO . | |

*Primary Examiner*—Forester W. Isen
*Attorney, Agent, or Firm*—C. A. Rowley

[57] ABSTRACT

A self-steering platform system incorporates at least three and preferably four microphones circumferentially spaced about the platform which is mounted for movement preferably around two mutually perpendicular axes. A sound source is selected and separate audio signals from the microphones are analyzed by a control which based on differences between the signals from the microphones emanating from the selected source determines the location of the selected source. The orientation of the platform is then adjusted by the control relative to the selected sound source. The present invention is particularly useful for mounting a shotgun or parabolic microphone to enhance sound from a selected source.

2 Claims, 5 Drawing Sheets

TRACKING PLATFORM SYSTEM

This is a continuation of Ser. No. 08/054,968, filed May 3, 1993, now abandoned

FIELD OF THE INVENTION

The present invention relates to a self-steering platform mechanism more particularly the present invention relates to a self-steering acoustical system for directing a platform that may mount a microphone or some other device at a selected sound source.

BACKGROUND OF THE PRESENT INVENTION

Discriminating sound and improving the signal to noise ratio (SNR) of sound emanating from a selected source is a problem not limited to the hard of hearing people who wear hearing aids that amplify the background noise as well as the sound that is attempting to be understood. People with effective hearing also face difficulties in hearing performer or speakers when the amplifying system is not properly operating or is not focused on the desired sound source.

Systems for enhancing sounds from particular sound sources generally employ an array of microphones i.e., usually more than 10 and in many cases, closer to 60 as described for example, U.S. Pat. No. 4,696,043 issued Sep. 22, 1987 to Iwahara et al. which employs a linear array of microphones divided into a plurality of sub arrays and utilizes signal processing to enhance the signals emanating from the selected source, i.e., from a selected direction.

U.S. Pat. No. 4,802,227 issued Jan. 31, 1989 to Elko describes another system of sound processing utilizing an array of microphones and emphasizing only those signals emanating from a selected direction and having a specified frequency range.

It will be apparent that any system that employs a large array of microphones is likely to be relatively expensive.

U.S. Pat. No. 4,037,052 issued Jul. 19, 1977 to Doi describes a sound pickup system that utilizes a parabolic mike with a pair of mikes positioned one at each side of the parabolic mike to obtain a particular sound pickup, there are no steering devices in this system. However, the structure includes a system incorporating a primary directional microphone plus at least one pair of auxiliary microphones shielded relative to the direction in which the primary microphone is directed.

U.S. Pat. No. 3,324,472 describes an antenna system where a main antenna is flagged by four peripheral receiving horns, a correction for the main antenna with alignment is calculated based on the discrepancy in the signals received by the antenna and is used to control an electromechanical steering device to adjust the alignment of the antenna. This device is particularly designed for properly directing a satellite mounted antenna system. This device can only be used effectively in the case where there is a single continuous source and applies only to electromagnetic signals.

BRIEF DESCRIPTION OF THE PRESENT INVENTION

It is the object of the present invention to provide a self-steering platform where a selected sound source is localized amongst several sound sources and the platform steered theretoward.

It is a further object of the present invention to provide an acoustic system wherein a directional microphone is mounted on a steerable platform that is controlled based on the dynamic location of the sound source to continuously steer the microphone toward the selected sound source.

Broadly, the present invention relates to a self-steering platform and a method of steering the platform comprising at least three microphones mounted in circumferentially spaced relationship around the periphery of said platform, means to mount said platform for orientation relative to two mutually perpendicular axes, drive means to drive said platform for orientation relative to said axes, a control system, means connecting said microphones to said control system so that each of said microphones provides a separate audio signal to said control system, said control system having means processing said audio signals including means to identify a selected sound source from a plurality of sound sources based on said audio signals and means to actuate said drive means to steer said platform toward said selected source based on the differences in sound signals from said selected source received by said microphones and delivered as said audio signals to said control system.

Preferably said means for processing said audio signals includes means convert said audio signals into substantially discreet narrow peaks.

Preferably, said microphones will be mounted on said platform.

Preferably, there will be four microphones arranged in two pairs with the microphones of a first pair of said two pairs being mounted in spaced relationship along a first axis and the microphones of a second pair of said two pairs mounted in space relationship on a second axis substantially perpendicular to said first axis.

Preferably, the first axis will be parallel with one of said pair of mutually perpendicular axes and said second axis will be parallel to the other of said pair of mutually perpendicular axes.

Preferably, a camera will be mounted on said platform in a position to be steered by said platform.

Preferably, a directional microphone is mounted on said platform in a position to be steered by the orientation of said platform, preferably, said directional microphone will be either a shotgun-type microphone or a parabolic microphone.

Preferably, said control system determines the time interval between selected portions of said audio signal from one microphone of said first pair of microphones relative to the corresponding portion of said audio signal from the other microphone of said first pair of microphones and controls movement around the one of said mutual perpendicular axes perpendicular to said first axis based on said time.

BRIEF DESCRIPTION OF THE DRAWINGS

Further features, objects and advantages will be evident from the following detailed description of the preferred embodiments of the present invention taken in conjunction with the accompanying drawings in which.

DESCRIPTION OF THE PREFERRED EMBODIMENTS

Figure 1:
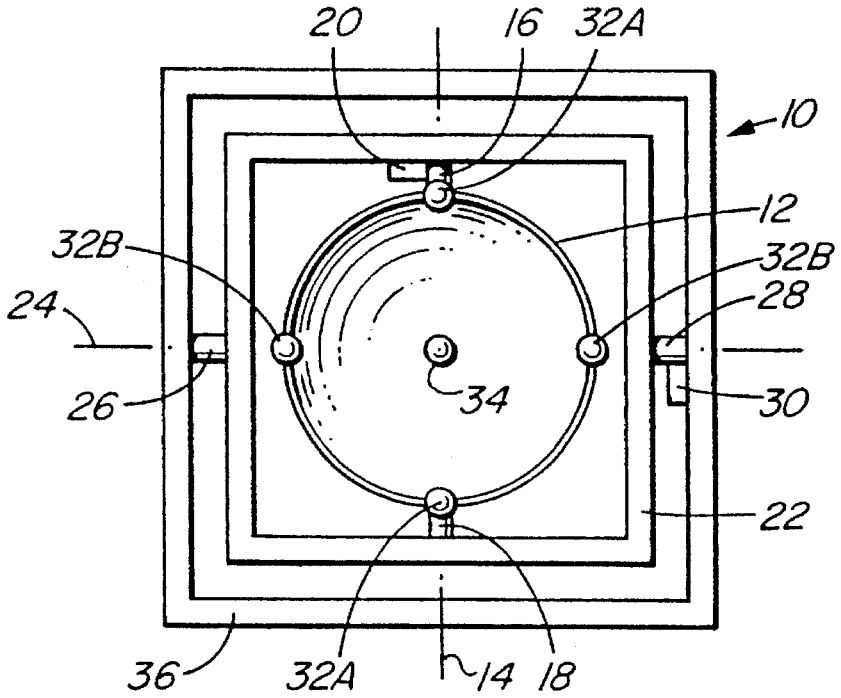
FIG. 1 is a schematic face-on view of a platform mounting mechanism constructed in accordance with the present invention.

The construction of one form of suitable platform mechanism, a gimbal system 10 is illustrated in FIG. 1. The central platform 12 is mounted on a first axis 14 formed by axially aligned stub shafts 16 and 18 at least one of which is driven by a suitable motor 20.

The stub shafts 16 and 18 are mounted on the rectangular frame 22 which in turn is mounted for rotation around axis 24 which is perpendicular to the axis 14. The frame 22 is mounted upon axially aligned stub shafts 26 and 28, one of which is driven by a drive motor 30.

The motor 20 rotates the platform 12 around the axis 14 (vertical axis in the illustrated arrangement) whereas motor or drive 30 pivots the platform 12 around the axis 24 (horizontal axis in the illustration) so that the platform 12 is driven about a pair of mutually perpendicular axes 14 and 24 which in the illustrated arrangement have been shown as vertical and horizontal but may be at any selected angle, vertical and horizontal being preferred.

Mounted at spaced location surround the periphery of the platform 12 are microphones 30, in the illustrated arrangement four microphones 32A first pair of microphones 32A, 32A are positioned along the first axis 14 one on each side of the platform 12 and a second pair of microphones 32B, 32B on the second axis 24 one on each side of the platform 12. In the illustrated arrangement, all of the microphones 32 are mounted on the movable platform 12 as this is the preferred in that it permits verifying the orientation of the platform relative to the sound source being monitored as will be described here.

Four microphones 32 have been shown, but three suitably spaced around circumference of the platform 12 may be used. However, when three are used, the control of movement of the platform is more complicated.

Mounted at the centre of the platform 12 is the device 34 that the system is intended to steer or direct. In the preferred arrangement this device 34 will be some form of directional microphone such as the shotgun microphone or more preferably as in the illustrated arrangement a disk or parabolic type microphone wherein the platform forms the parabolic portion of the microphone as indicated by the reference 12A. However, the platform can equally be used to steer a video camera or the like positioned at the centre of the platform 34 (intersection of the two axes 14 and 24).

Figure 2:
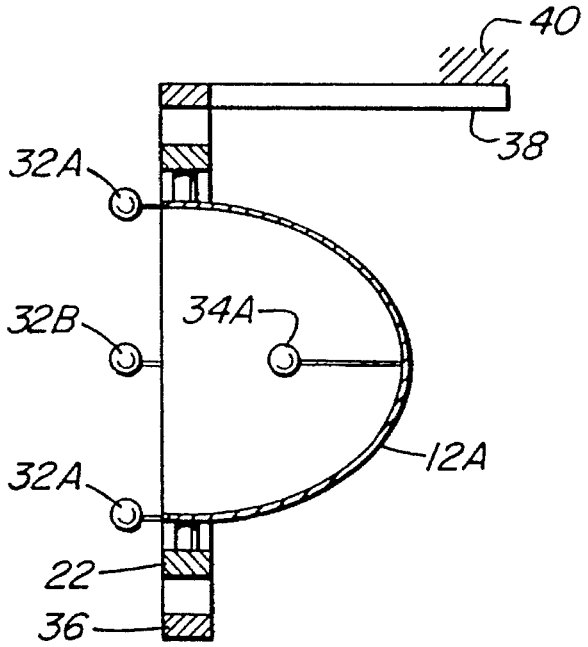
FIG. 2 is a sectional on the lines 22 of FIG. 1 illustrating the present invention, used to support a parabolic dish microphone as the platform.
Figure 3:
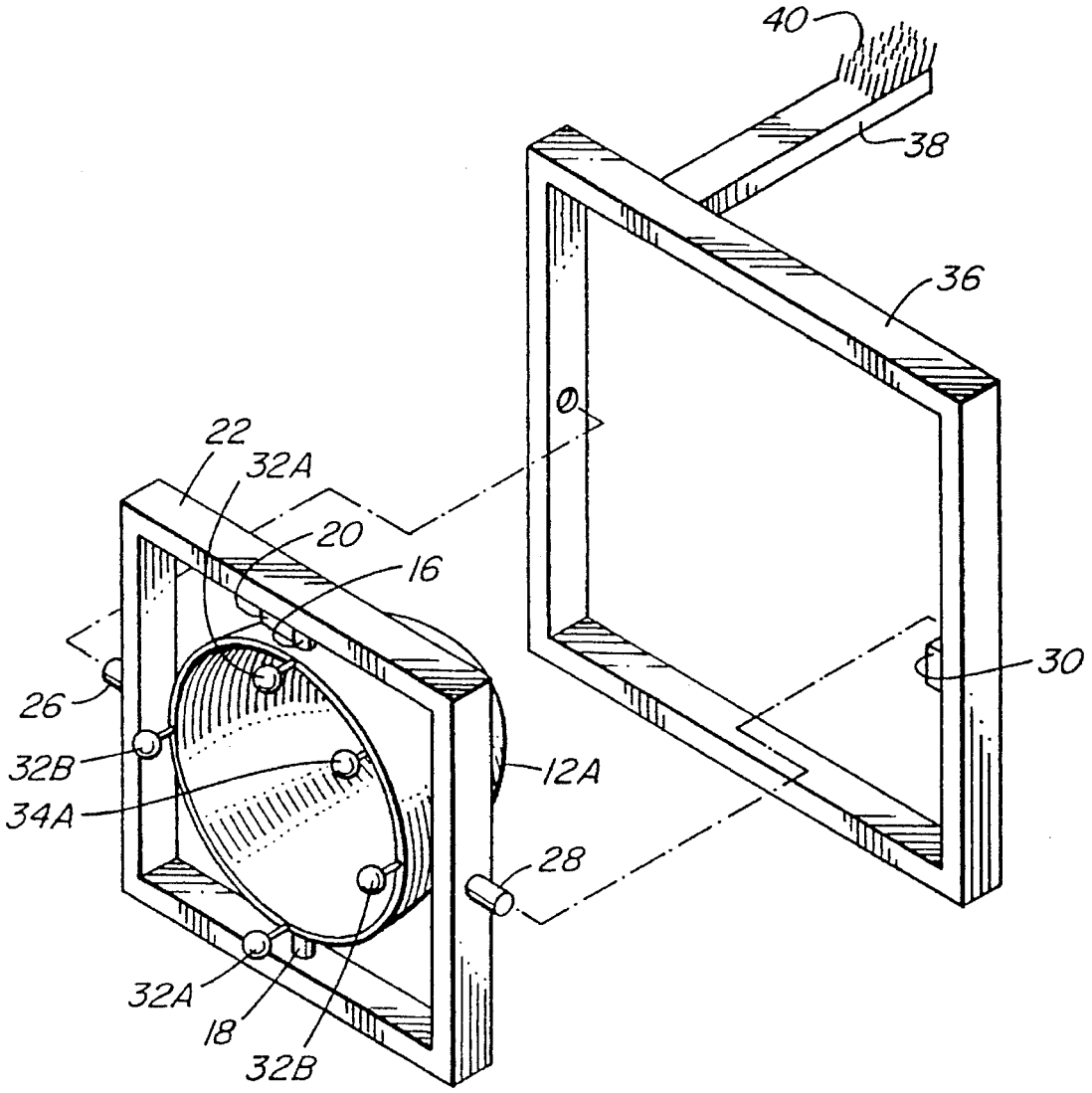
FIG. 3 is a partial exploded view schematically illustrating the invention.

As shown in FIG. 2, the outer frame 36 of the gimbal 10 may be mounted by a suitable support bar the like 38 from a fixed frame or the like 40 so that the whole system 10 may be mounted in the desired position, i.e., fixed in the desired position, relative to what is to be monitored eg. a sound source.

Figure 4:
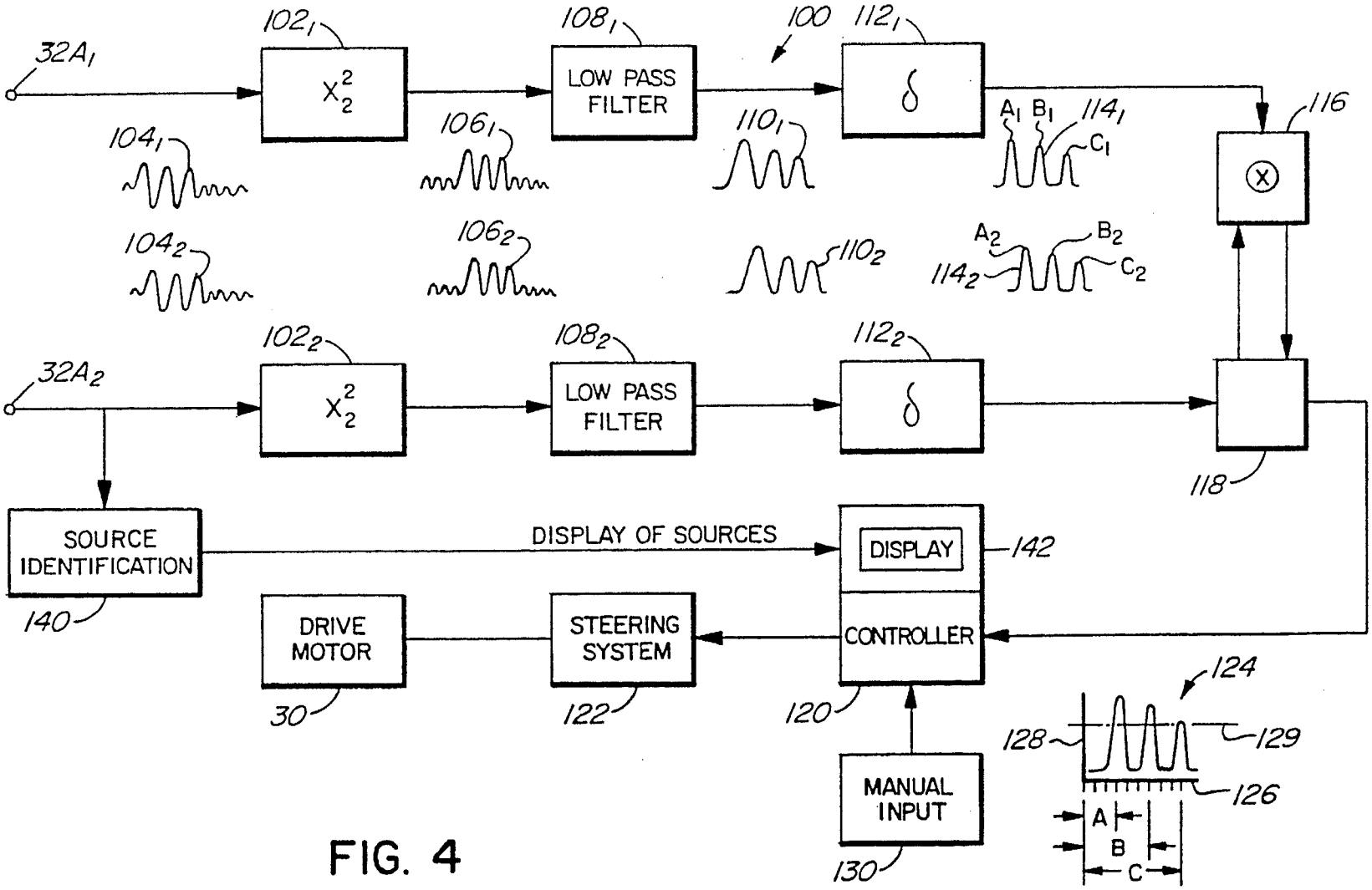
FIG. 4 is a schematic illustration of one form of the control system of the present invention.

The microphones 32A of the first pair of microphones are connected to a first direction sensing system and the microphones 32B of the second pair of microphones to a second direction sensing system, both of which are essentially identical and have been schematically illustrated at 100 in FIG. 4. Only one control system will be described, for the microphones 32A, it being understood that the microphones 32B function essentially the same manner but the control movement around axis 14 rather than around axis 24.

For the purposes of FIG. 4, one of the microphones of the pair being described is designated $32A_1$ and the other $32A_2$ with corresponding parts of the signal processor, i.e., for the signal generated by microphone $32A_1$ being designated by the a numeral followed by the designation sub 1 and for signal from microphone $32A_2$ using the same numbers as used the system for microphone $32A_1$ but followed by the sub 2 designation.

As shown in FIG. 4 the signals from the microphones $32A_1$ and $32A_2$ are delivered to their respective rectifying systems 102 which convert the signal as indicated 104 to a signal represented at 106 by rectifying the signal 104.

The rectified signal 106 passes through a low pass filter 108 which smooths the rectified signal 106 and forms discreet peaks to provide a smoothed signal as indicated at 110.

The signal 110 is decimated at local maxima as indicated by the decimator 112 i.e. the value of the envelope at the local maxima location is retained and is set to zero everywhere else. Local maxima is the point for which the envelope has a greater amplitude than the values on either side of it. A decimated signal 114 is schematically indicated by the discreet narrow peaks designated as A, B and C respectively.

The corresponding peaks generated from the microphone $32A_1$ have been indicated as $A_1$, $B_1$, $C_1$ and the corresponding peaks generated by the microphone $32A_2$ as peaks $A_2$, $B_2$, $C_2$. It will be noted that the peak $A_1$ is offset from the peak $A_2$ by a distance equivalent to a time which is based on the different distances the microphone $32A_1$ and $32A_2$ are from the source of sound.

The peaks $A_1$, $B_1$ and $C_1$ may each represent different sound sources, eg., different speakers have different speech patterns and these peaks $A_1$, $B_1$ and $C_1$ each are designated to represent a different speaker and the peaks $A_2$, $B_2$ and $C_2$ obviously represent the corresponding speaker $A_1$, $B_1$ and $C_1$ respectively.

In signal $114_1$ and $114_2$ are compared in the comparer 16 and the signals aligned by the time delay system 118 so that the peak $A_1$ and $A_2$ are in alignment and the difference in the time required to align the peaks $A_1$ and $A_2$ (or $B_1$ and $B_2$ or $C_1$ and $C_2$) is used in control 120 to control the steering system 122 which in turn control the drive motor 30.

In the scale 124 the timing offset as designated by the scale 126 provides the increment of movement necessary as indicated by the scale 126 to be applied to the drive motor 30 to focus the centre 34 of the platform 12 at the desired source of sound, i.e., if the source represented by the signal A is to be selected, then the increments or movements are designated by the dimension A and those for the sound source B by the dimension B and for the sound source C by the dimension C. The dimensions A, B and C are each measured from a neutral or datum position 128 which is defined by the current position or orientation of the platform 12 relative to sound source.

It will be apparent that other suitable acoustic signal processor systems that can simultaneously localize multiple sound sources based on the differences in signals from microphones of a set of microphones may be employed, The most common such processor calculates the difference between pairs of sensors at a set frequency. With this common system the operation of the device is limited in that if the sound spectrums from the various sources are overlapped, the processor provides the average of the source positions without an indication of the failure.

The system of the present invention as described above is capable of defining the location of multiple sound sources and is preferred, particularly for monitoring and tracking human voices as it takes advantage of the fact that human speech contains a large number of sharp transients. The system of the present invention described above rather than being based on the phase difference between the signal at each microphone is based on the value of the envelope at the local maxima location and is set to zero elsewhere. The cross correlation of two resulting time series presents peaks $A_1$, $A_2$, $B_1$, $B_2$, $C_1$, $C_2$ and as illustrated at 124 in FIG. 1 may be accomplished even if the sound spectra from the different sources overlap considerably.

Even the system described above is not absolute and may fail if no clear peak emerges in the cross correlation. The operation of the system may be improved by imposing a threshold as indicated at 129 to peak signals representing the selectable sources and thus their corresponding source directions.

Figure 5:
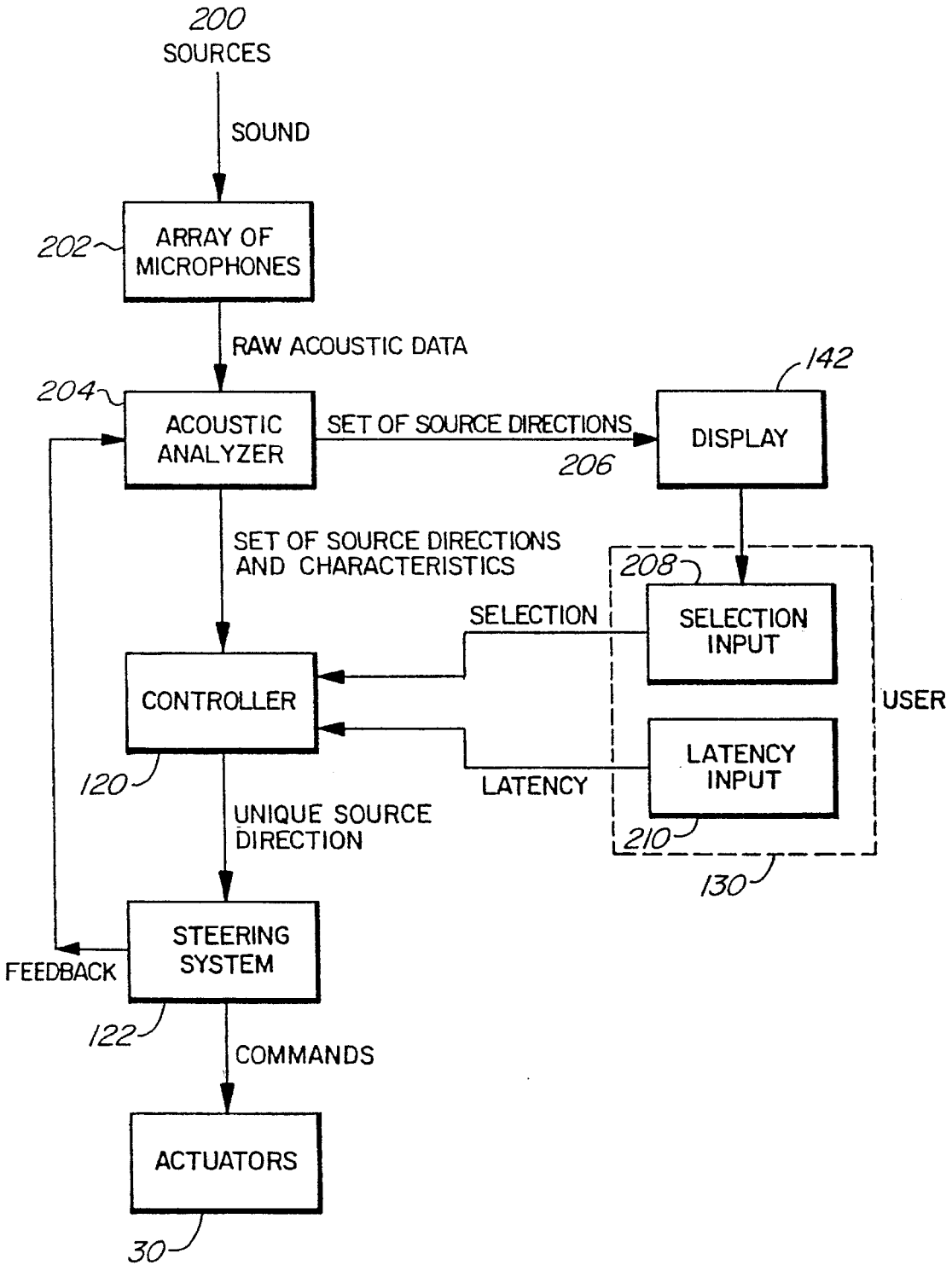
FIG. 5 is a flow diagram of a control system (source selection and tracking system) of one embodiment of the invention.

Referring to FIG. 5 the operation of the source selection and tracking system is as follows.

Sound from the sound source schematically indicated at 200 is received by the array of microphones 202 (i.e. microphones 32) which deliver the acoustic analyzer i.e the 100 including elements 102, 108, 112, 116, 118 and 140, etc.). The acoustic analyzer 204 determines source directions and displays them via the display 142 and provides this information to the controller 120.

The visual display is read by the user, who as schematically represented by the arrow 206 selects a sound source using the selection input 208 of the manual input system 130 to instruct the controller 120 which source the user prefers to follow and the controller 120 sends a unique source direction to the steering system 120 which in turn operates the actuators or motors 30.

It will be apparent that the selected source (source with the highest priority may stop emitting sounds (i.e. stop talking). The manual controller 130 may be activated by the user, or in the illustrated arrangement a latency time t, the duration of which may either be a default time of be set by the user as indicated at 210. When the source of highest priority is silent for a time period longer than the time period t, the system may be programmed to turn to and track the sound source with the next highest priority.

The steering system 122 may feedback the position of the platform to verify that the position in which the platform is being oriented corresponds with the detected location of the sound source being tracked.

Figure 6:
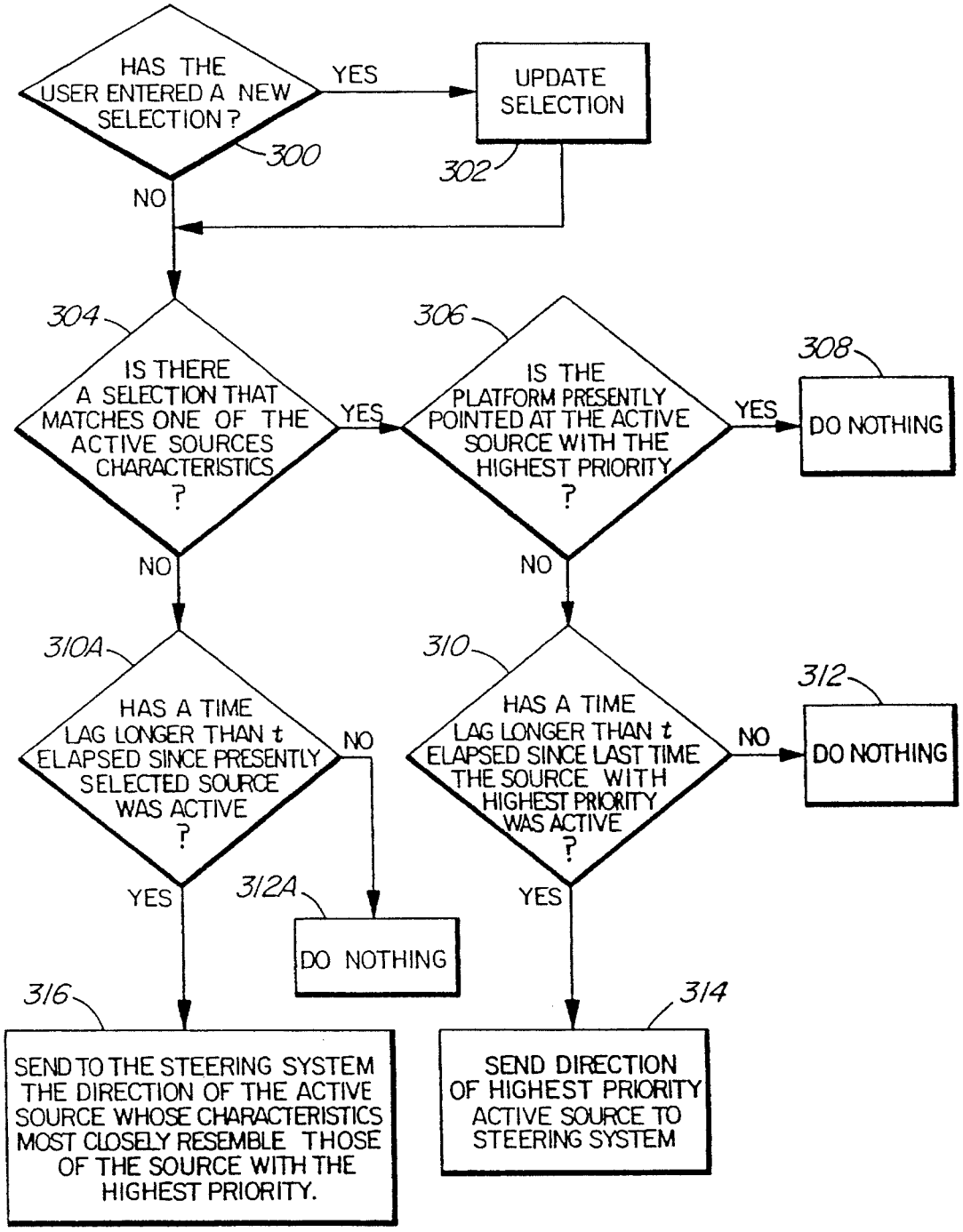
FIG. 6 is a flow diagram of a controller algorithm for use in the invention.

An example of a suitable controller algorithm is schematically illustrated in FIG. 6. As shown the controller 120 first determines if a new source has been selected as indicated at 300, if yes the selection is updated as indicated at 302. This most current data is used to determine if a sound source matches the characteristics of one of the selected sound sources (source of highest priority) as indicated at 304.

If there is a match between one of the active sources (i.e. the answer is yes) the controller 120 determines if the platform 12 is pointed at the then current position of the selected source of highest priority as indicated at 306, and if so does nothing as indicated at 308. On the other hand if the platform is not pointed in the correct direction the controller first determines the if latency time period t has or has not lapsed since the selected source (highest priority sound source) was active as indicated at 310 and if the period t has not elapsed the system does nothing as indicated at 312, however, if the time period t has elapsed system instructs the steering system to the highest priority active source as indicated at 314.

The hierarchy of sources is established by the user as indicated at 208 in FIG. 5, if he selects more than one source to be followed. Thus if source A is selected as the highest priority and B as the second highest and sound source A becomes quiet for more than the latency time period set by the used as indicated at 210 and sound source B is active then the platform 12 is turned to sound source B. If at any time the source A becomes active the platform immediately turns to source A. If desired the system could be modified to stay with B until that source became quiet before turning back to A if desired, however if the used were to desire to stay with sound source B he could override the automatic control and set B as the higher priority for the time being.

If no match is found between the between the sources and the selected source, the first it is determined if the latency period t has or has not lapsed since the selected one of the sources was active as indicated at 310A, if not do nothing as indicated at 312A, and if yes instruct the steering system to steer to the active source whose characteristics most closely resemble the selected source as indicated at 316 or to the next higher priority source if it becomes activated as discussed above.

The source most closely resembling the selected sound source will normally be selected on the basis of the criteria used to differentiate between sound sources i.e. frequency, repetition, etc.

The motor 30 may be a simple step motor so that the number of increments as designated by the selected dimension A, B, or C may be applied to the step motor the corresponding number of steps depending on which of the sound sources it is desired to follow and focusing the platform theretoward.

It will be apparent where there are multiple sources i.e., different peaks, A, B, C, etc., each represent a different speaker (identified by frequency or some other speech recognition pattern) that the person receiving the signal from, let say, the source A may not wish to concentrate on selected source A which the system was set to track the control 120 may be overridden by the manual control 130.

The system may be set to automatically select the source based on for example frequency, amplitude, initial location etc. and a manual override 130 may be activated as desired to select the particular source A, B, or C that is desired to monitor.

Obviously to permit one to select a sound source there must be a system of identifying the different sound sources so they may be selected. This is attained by the source identification device 140 which receives and analyses the sound received by at least one of the microphones (in the illustration of FIG. 4 the microphone 32$A_2$. The system used by the sound identification means 140 may be any suitable acoustic analyzer or acoustic signal processor that identifies different spectra from the sound sources such as fundamental frequency or repeat rate, etc. and tags that source based on the selected characteristic.

The relative positions of the various sound sources are displayed on the display 142 forming part of the controller 120 and the manual input device 130 may the select one of the sources as having the highest priority and direct the controller 129 to control the steering system 122 to operate the drive motors 30 to steer the platform 12 based on sound emanating from the source to which the highest priority has been applied.

By providing a number of different systems i.e. platforms 12 with directional microphones 34 each system may be set to automatically track a selected one of a plurality of sound sources.

Only one pair of microphones 32A or 32B need be used if the microphone 34A or camera is to be directed on one axis only. If two axis are to be included, the system 100 will be provided for both microphones 32A and 32B to each one of the drives 20 and 30 being controlled accordingly.

While the invention is being primarily described in relation to a sound system, i.e., the microphone 34A, the system of the present invention may be used as above indicated to steer a camera or any other device that it is desired to focus on a selected sound source.

Having described the preferred form of the invention, modifications will be evident to those skilled in the art without departing from the scope of the invention as defined in the appended claims.

We claim:

1. A signal processing system for identifying different localized sound sources for aiming a self steering system comprising a plurality of microphone means arranged in spaced relationship relative to each other, each of said microphone means receiving input signals from each of said different localized sound sources and generating its respective audio signal based on said input signals it received from all of said localized sources, means for processing said audio signals from each said microphone said means for processing including means to identify a selected sound source from said different sound sources, means to determine an envelope for each of said audio signals, rectifier means for producing a rectified signal, low pass filter means for filtering said rectified signal to provide a filtered signal and means for non-linearly processing said envelopes including means to decimate said filtered signal at local maxima and to define discrete narrow peaks representative of input signals received from each said localized source, means to determine a time delay between said peaks defined in at least two of said audio signals and representative of a selected one of said localized sources, control means to aim said system and means for operating said control means based on said time delay.

2. A signal processing system as defined in claim 1 wherein said plurality of microphone means comprise four said microphone means arranged in two pairs with microphone means of a first pair of said two pairs being mounted in spaced relationship along a first axis and microphone means of a second pair of said two pairs mounted in spaced relationship on a second axis substantially perpendicular to said first axis.

* * * * *